US009768508B2

(12) United States Patent
Hwang et al.

(10) Patent No.: US 9,768,508 B2
(45) Date of Patent: Sep. 19, 2017

(54) ANTENNA SYSTEM FOR SIMULTANEOUS TRIPLE-BAND SATELLITE COMMUNICATION

(71) Applicants: Ki Min Hwang, Daejeon (KR); Jong Wan Heo, Daejeon (KR); Kun Sup Kwon, Daejeon (KR)

(72) Inventors: Ki Min Hwang, Daejeon (KR); Jong Wan Heo, Daejeon (KR); Kun Sup Kwon, Daejeon (KR)

(73) Assignee: AGENCY FOR DEFENSE DEVELOPMENT (KR)

( * ) Notice: Subject to any disclaimer, the term of this patent is extended or adjusted under 35 U.S.C. 154(b) by 101 days.

(21) Appl. No.: 14/225,597

(22) Filed: Mar. 26, 2014

(65) Prior Publication Data

US 2015/0097747 A1 Apr. 9, 2015

(30) Foreign Application Priority Data

Oct. 4, 2013 (KR) ..... 10-2013-0118743

(51) Int. Cl.
*H01Q 13/02* (2006.01)
*H01Q 5/47* (2015.01)
(Continued)

(52) U.S. Cl.
CPC ..... *H01Q 5/47* (2015.01); *H01P 1/161* (2013.01); *H01Q 13/0208* (2013.01); *H01Q 13/0258* (2013.01); *H01Q 13/24* (2013.01)

(58) Field of Classification Search
CPC .... H01C 13/02; H01C 5/001; H01C 13/0208; H01C 5/47; H01C 13/24; H01C 13/0258; H01P 1/161
(Continued)

(56) References Cited

U.S. PATENT DOCUMENTS 4,074,265 A * 2/1978 True ..... H01P 5/12 333/122
4,472,721 A * 9/1984 Morz ..... H01Q 13/0225 333/21 R
(Continued)

FOREIGN PATENT DOCUMENTS

EP 0 057 402 A2 1/1982
EP 0 417 356 A1 11/1989
(Continued)

OTHER PUBLICATIONS

Armaki et al. "A New Profile for Metal Post Circular Waveguide Polarizer," Progress in Electromagnetics Research Symposium Proceedings, Cambridge, USA, Jul. 5-8, 2010.*
(Continued)

*Primary Examiner* — Dieu H Duong
*Assistant Examiner* — Bamidele A Jegede
(74) *Attorney, Agent, or Firm* — Ostrolenk Faber LLP

(57) ABSTRACT

An antenna system for triple-band satellite communication according to one exemplary embodiment of the present disclosure includes a feed horn device that is configured to simultaneously radiate or absorb wireless signals of triple bands including X, Ku and Ka bands, and a waveguide section that is coupled to the feed horn device and configured to transmit input and output of the wireless signals, wherein the feed horn device includes a corrugation horn that is configured to radiate or absorb the wireless signals of the X and Ku bands, the corrugation horn having a bell-like shape with a plurality of corrugations formed on an inner circumferential surface thereof in a stepped manner, and a dielectric feed horn that is configured to radiate or absorb the wireless signal corresponding to the Ku band and disposed in a central region of the corrugation horn.

8 Claims, 8 Drawing Sheets

(51) Int. Cl.
*H01Q 13/24* (2006.01)
*H01P 1/161* (2006.01)

(58) Field of Classification Search
USPC ..... 343/785
See application file for complete search history.

(56) References Cited

U.S. PATENT DOCUMENTS 5,486,839 A * 1/1996 Rodeffer ..... H01Q 13/0208 343/772
5,552,797 A * 9/1996 Cook ..... H01Q 13/0208 343/786
6,549,173 B1 * 4/2003 King ..... H01Q 1/247 343/772
6,879,289 B2 * 4/2005 Hayes ..... H01P 1/2005 333/161
7,002,528 B2 * 2/2006 Moheb ..... H01Q 13/0208 343/781 R
7,439,925 B2 * 10/2008 Huang ..... H01Q 13/0266 333/21 A
7,511,678 B2 * 3/2009 Wu ..... H01Q 5/47 343/786
7,755,557 B2 * 7/2010 McGonigle ..... H01Q 13/0208 343/772
2005/0116871 A1 * 6/2005 Moheb ..... H01Q 13/0258 343/772
2010/0019981 A1 * 1/2010 Ergene ..... H01Q 13/0208 343/858
2011/0181479 A1 * 7/2011 Martin ..... H01Q 13/025 343/756
2012/0169557 A1 * 7/2012 Naym ..... H01Q 25/04 343/756
2012/0268329 A1 * 10/2012 Laidig ..... H01Q 1/247 343/702

FOREIGN PATENT DOCUMENTS

KR 10-2006-0096880 9/2006
KR 10-2010-0127045 12/2010

OTHER PUBLICATIONS

Notice of Allowance issued by the Korean Patent Office on Aug. 28, 2014 in connection with corresponding Korean Patent Application No. 10-2013-0118743.

* cited by examiner

ANTENNA SYSTEM FOR SIMULTANEOUS TRIPLE-BAND SATELLITE COMMUNICATION

CROSS-REFERENCE TO RELATED APPLICATION

Pursuant to 35 U.S.C. §119(a), this application claims the benefit of earlier filing date and right of priority to Korean Application No. 10-2013-0118743, filed on Oct. 4, 2013, the contents of which is incorporated by reference herein in its entirety.

BACKGROUND OF THE DISCLOSURE

1. Field of the Disclosure

This specification relates to an antenna system for satellite communications, and particularly, to an antenna system for simultaneous triple-band satellite communications, capable of simultaneously transmitting and receiving signals corresponding to X, Ku, Ka bands (hereinafter, referred to as a triple-band) using a single feed horn.

2. Background of the Disclosure

Satellite communication refers to wireless communication which is carried out using a satellite, which is launched to an orbital path to orbit the earth, as a relay station. The satellite communication has several advantages in view of enabling high-speed mass communication, using a wide area as a communication coverage, and ensuring uniform communication irrespective of topographical features.

In recent time, owing to development of a multi-band satellite communication terminal, which is capable of transmitting and receiving signals of various frequency bands through one satellite communication terminal device, an efficient use of the satellite and improvement of communication capability of the terminal are optimized.

A terminal for satellite communication widely uses a reflector-type antenna which has strong directivity. The reflector-type antenna requires for an antenna system which feeds to a reflector and serves as a first (or primary) ejector.

The related satellite communication terminal has been developed to be simultaneously operated only on a single band or partially on a dual band. Even if it is operated on a multi-band, the operation requires for a replacement of a feed horn or of a plurality of feed horns and an installation of a frequency-selective structure for frequency alignment corresponding to those feed horns.

SUMMARY OF THE DISCLOSURE

Therefore, to obviate the drawbacks of the related art, an aspect of the detailed description is to provide an antenna system for a triple-band satellite communication having a single feed horn structure capable of simultaneously transmitting and receiving signals of triple bands, namely, X, Ku and Ka, and more particularly, an antenna system for satellite communication terminal, capable of simultaneously handling triple-band signals without a separate horn replacement or switching of a transmission/reception path, and being implemented without a separate frequency-selective structure, unlike an antenna system applied to the conventional multi-band satellite communication terminal.

To achieve these and other advantages and in accordance with the purpose of this specification, as embodied and broadly described herein, there is provided an antenna system for triple-band satellite communication, including a feed horn device that is configured to simultaneously radiate or absorb wireless signals of triple bands including X, Ku and Ka bands, and a waveguide section that is coupled to the feed horn device and configured to transmit input and output of the wireless signals, wherein the feed horn device may include a corrugation horn that is configured to radiate or absorb the wireless signals of the X and Ku bands, and has a bell-like shape with a plurality of corrugations formed on an inner circumferential surface thereof in a stepped manner, and a dielectric feed horn that is configured to radiate or absorb the wireless signal corresponding to the Ku band and disposed in a central region of the corrugation horn.

In accordance with one exemplary embodiment disclosed herein, the waveguide section may include a coaxial waveguide having an inner side configured to interconnect the dielectric feed horn and a first waveguide, and an outer side configured to interconnect the corrugation horn and a second waveguide, and a turnstile junction portion that is configured to interconnect the coaxial waveguide and the second waveguide.

In accordance with one exemplary embodiment disclosed herein, the turnstile junction portion may include four double-rigid waveguides that are configured to interconnect the outer side of the coaxial waveguide and the second waveguide such that the wireless signals of the X and Ku bands are spaced, respectively, by more than half wavelength on the orthogonal mode basis.

In accordance with one exemplary embodiment disclosed herein, the antenna system may further include a diplexer connected to the turnstile junction portion and configured to separate or combine the wireless signals of the X and Ku bands. The diplexer may include a common port, and first to third ports connected to the common port and orthogonal to one another. A horizontal polarization and a vertical polarization of the X-band wireless signal may be separated or combined for transmission through the first and second ports, and the Ku-band wireless signal may be transmitted through the third port.

In accordance with one exemplary embodiment disclosed herein, the antenna system may further include a first orthogonal mode transducer connected to the third port and configured to separate or combine a horizontal polarization and a vertical polarization of the Ku-band wireless signal.

In accordance with one exemplary embodiment disclosed herein, the antenna system may further include a polarizer formed at one side of the first waveguide, and configured to generate a circular polarization with respect to the Ka-band wireless signal.

In accordance with one exemplary embodiment disclosed herein, the antenna system may further include a second orthogonal mode transducer connected to the polarizer and configured to separate or combine a horizontal polarization and a vertical polarization of the Ka-band wireless signal.

In accordance with one exemplary embodiment disclosed herein, the polarizer may be a corrugation polarizer configured in a manner of forming a plurality of corrugated portions in a sawtooth shape along an inner circumference of a waveguide having a square section.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of a log-periodic dipole array antenna according to the exemplary embodiments, with reference to the accompanying drawings. Hereinafter, suffixes "module" and "unit or portion" for components used herein in description are merely provided only for facilitation of preparing this specification, and thus they are not granted a specific meaning or function. Hence, it should be noticed that "module" and "unit or portion" can be used together. For the sake of brief description with reference to the drawings, the same or equivalent components will be provided with the same reference numbers, and description thereof will not be repeated. The expression in the singular form in this specification will cover the expression in the plural form unless otherwise indicated obviously from the context.

Figure 1:
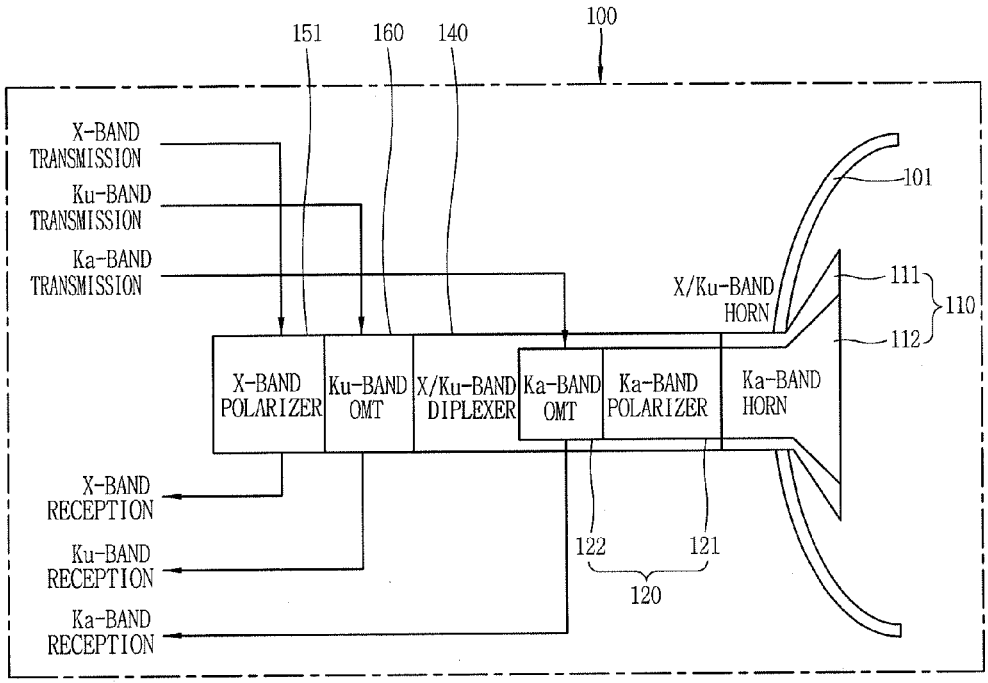
FIG. 1 is a signal flowchart illustrating an antenna system for triple-band satellite communication in accordance with an exemplary embodiment disclosed herein.

FIG. 1 is a signal flowchart illustrating an antenna system for triple-band satellite communication in accordance with an exemplary embodiment disclosed herein.

An antenna system 100 for triple-band satellite communication in accordance with one exemplary embodiment disclosed herein may exhibit the following signal flow. X and Ku-band signals coming from a reflector 101 may enter a turnstile junction portion 130 through a corrugation horn 111 of a feed horn antenna. The turnstile junction portion 130 may be used to separate (or isolate) polarization elements of the X- and Ku-band signals. The turnstile junction portion 130 may ensure a space for a Ka-band feed (a feed 120 may include a Ka-band polarizer 121 and a Ka-band orthogonal mode transducer 122 (hereinafter, referred to as a second orthogonal mode transducer)). The separated polarization elements may be combined again, and then separated into X and Ku signals through an X and Ku diplexer 140. For the Ku band, in order to use a linear polarization, the Ku-band signal may be separated into a vertical element and a horizontal element by using a first orthogonal mode transducer 160. For the X band, in order to use a circular polarization, the circular polarization may be separated using a hybrid polarizer. A phase error, which is generated in the X and Ku diplexer 140, may be compensated for by using a phase shifter. Even for the Ka band, in order to use the circular polarization, after a signal enters into a corrugation polarizer 121 through a dielectric feed horn 112, a transmission/reception signal may be separated using the second orthogonal mode transducer 122.

Here, the X band may be a communication band corresponding to 8 to 12 GHz, the Ku band may be a communication band corresponding to 12 to 18 GHz, and the Ka band may be a communication band corresponding to 27 to 40 GHz.

Figure 2:
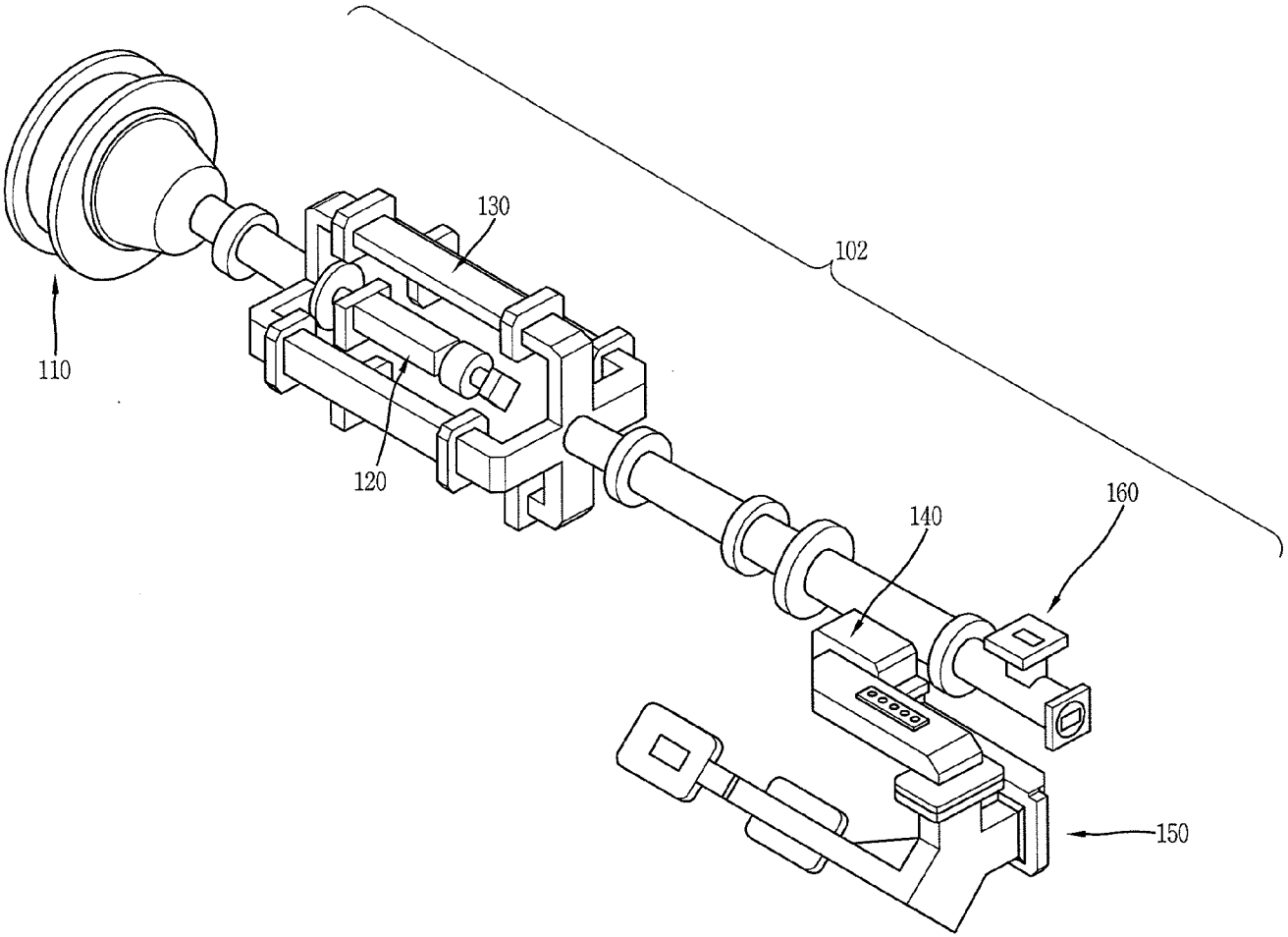
FIG. 2 is a perspective view of the antenna system for the triple-band satellite communication in accordance with the exemplary embodiment disclosed herein.

FIG. 2 is a perspective view of the antenna system 100 for the triple-band satellite communication in accordance with the exemplary embodiment disclosed herein.

As illustrated in FIG. 2, the antenna system 100 for the triple-band satellite communication according to the one exemplary embodiment may include a feed horn device 110 and a waveguide section 102.

The feed horn device 110 may construct a radiating element, which may include a corrugation horn 111 managing the X and Ku bands, and a dielectric feed horn 112 managing the Ka band.

That is, the feed horn device 110 may include the corrugation horn 111 and the dielectric feed horn 112. The corrugation horn 111 may radiate or absorb X- and Ku-band wireless signals. The corrugation horn 111 may have shape of a bell, which has a plurality of corrugations on its inner circumferential surface in a stepped manner. The dielectric feed horn 112 may radiate or absorb a wireless signal corresponding to the Ka band, and be arranged in a central region of the corrugation horn 111.

The waveguide section 102 may include first and second waveguides 132 and 133, a coaxial waveguide 131, and a turnstile junction portion 130. The waveguide section 102 may further include at least one of an X- and Ku-band diplexer 140, an X-band phase shifter 152, an X-band polarizer 151, a Ku-band orthogonal mode transducer (OMT) 160, a Ka-band polarizer 121, and a Ka-band OMT 122.

Figure 3A:
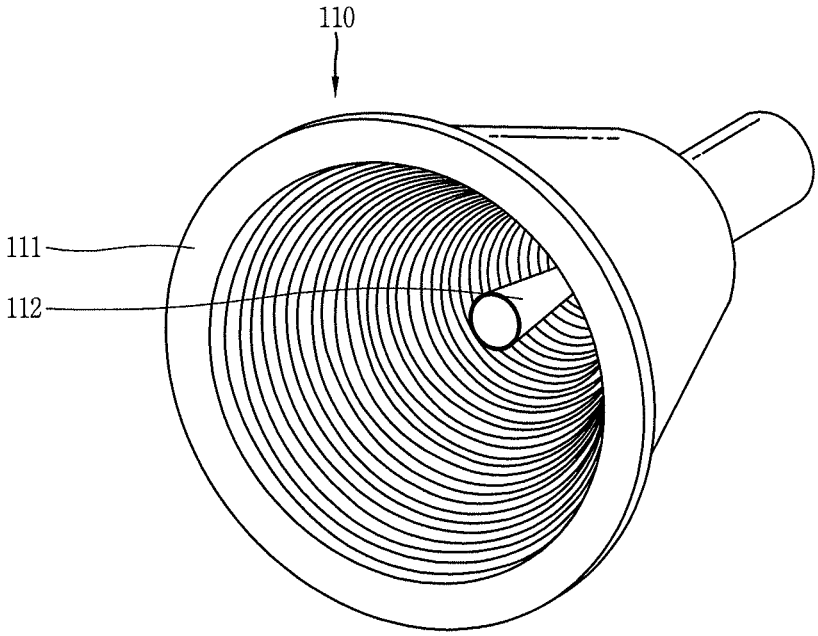
FIGS. 3A and 3B are a perspective view and a sectional view, respectively, illustrating an X- and Ku-band corrugation horn and a Ka-band dielectric feed horn of the antenna system for the triple-band satellite communication in accordance with the one exemplary embodiment disclosed herein.
Figure 3B:
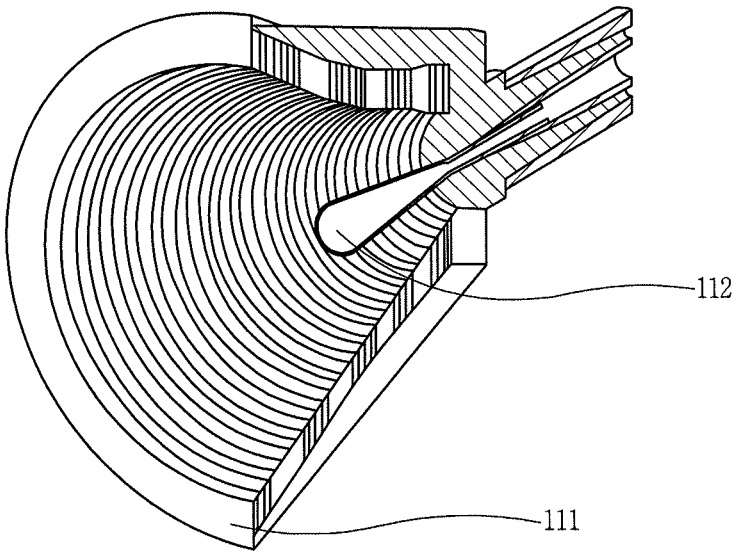

FIGS. 3A and 3B are a perspective view and a sectional view, respectively, illustrating the X- and Ku-band corrugation horn 111 and the Ka-band dielectric horn 112 of the antenna system 100 for the triple-band satellite communication in accordance with the one exemplary embodiment disclosed herein.

As illustrated in FIGS. 3A and 3B, the feed horn device 110 may include the corrugation horn 111 having broadband characteristics of X and Ku bands, and the dielectric feed horn 112 managing the Ka band. The feed horn device 110 may be designed into a structure that the Ka-band dielectric feed horn 112 is inserted into the X- and Ku-band corrugation horn 111. Various parameters, such as a shape of corrugation of the corrugation horn 111, the number of corrugations, depth and width of the corrugation and the like, may be changed to ensure an optimal pattern of the corrugation horn 111. Specifically, for the Ka band, a matching step has been designed using a conducting rod and a stepwise structure within the dielectric feed horn 112. The X- and Ku-band corrugation horn 111 may form corrugations in such a way that an E-plane and an H-plane maintain the same pattern characteristic. The Ka-band dielectric feed horn 112 may use Teflon, ceramic or rexolite dielectric to exert the least influence on the X- and Ku-band characteristics due to a coaxial mode. Here, it may be preferable to design the feed horn device 110 in a manner of minimizing a deviation of band-based phase centers.

Figure 4A:
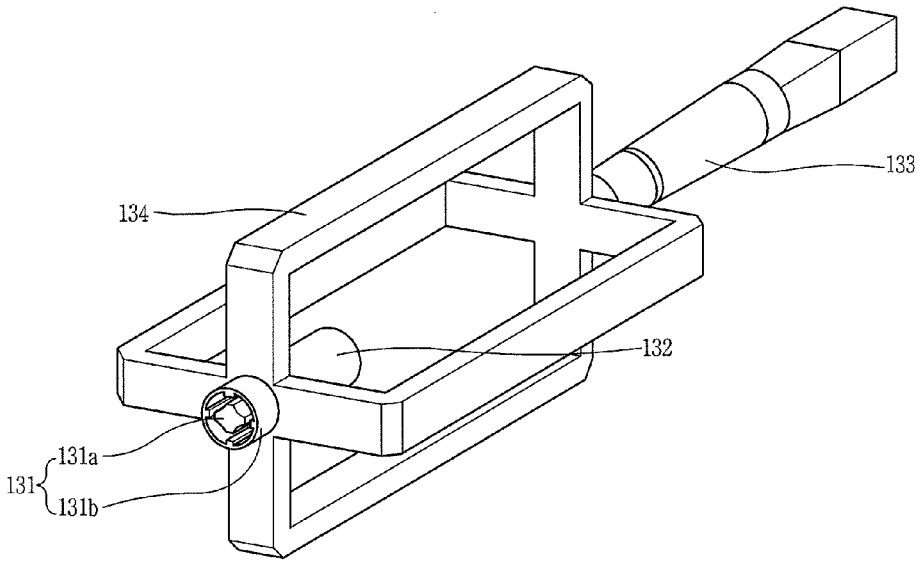
FIGS. 4A and 4B are a perspective view and a sectional view, respectively, of a waveguide section of the antenna system for the triple-band satellite communication in accordance with the one exemplary embodiment disclosed herein.
Figure 4B:
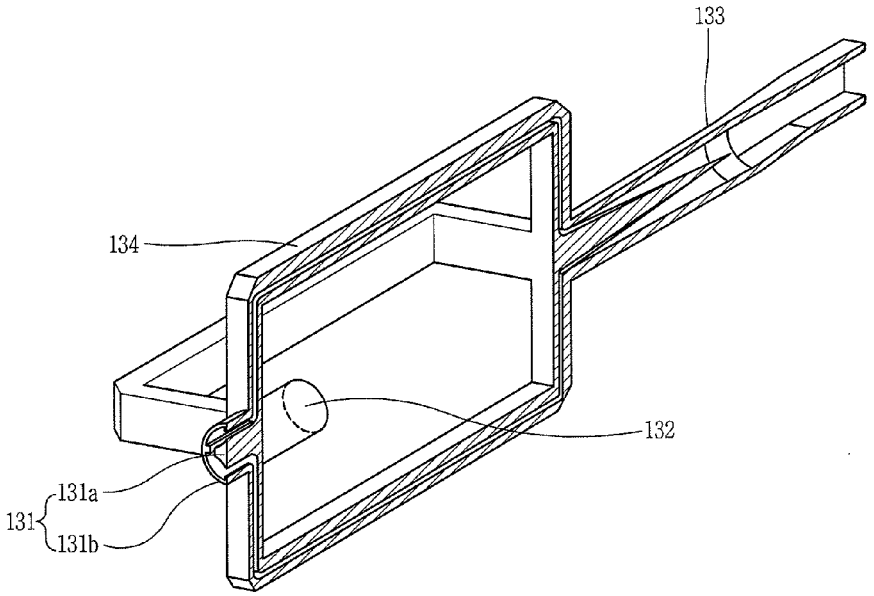

FIGS. 4A and 4B are a perspective view and a sectional view, respectively, of the waveguide section 102 of the antenna system 100 for the triple-band satellite communication in accordance with the one exemplary embodiment disclosed herein.

The X- and Ku-band turnstile junction portion 130, which is an assembly for a triple-band signal separation, may generally serve to separate (or isolate) or combine two different signals, which are orthogonal to each other, upon an uplink or downlink signal transfer through satellite communications. Owing to a non-requirement of a separate conductive pin or septum polarizer, the X- and Ku-band turnstile junction portion 130 may separate the signals in a simple manner. Also, the X- and Ku-band turnstile junction portion 130 may exhibit a good standing-wave ratio characteristic in a broadband.

The present disclosure has employed the turnstile junction portion 130 having a coaxial waveguide 131 formed at one side thereof so as to separate the X and Ku bands from the Ka band. An outer waveguide has been implemented as a double-rigid waveguide, which has a broadband characteristic, so as to facilitate a signal transmission in the X and Ku bands, and an inner waveguide may be implemented as a circular waveguide for a signal transmission in the Ka band. In the X and Ku bands, two signals orthogonal to each other may be separated into uniform signals of −3 dB by each side port of the turnstile junction portion 130. The separated signals may be re-combined with each other at a rear side of the turnstile junction portion 130 and thereafter separated into two frequency bands by the X and Ku diplexer 140. The separated X-band signal may be transferred to a phase shifter and a polarizer, and the Ku-band signal may be transferred to the first orthogonal mode transducer 160.

The coaxial waveguide 131 may be provided with an inner side 131*a* and an outer side 131*b*. The inner side 131*a* may be formed to interconnect the dielectric horn 112 and the first waveguide 132, and the outer side 131*b* may be formed to interconnect the corrugation horn 111 and the second waveguide 133.

One side of the first waveguide 132 may be connected to the dielectric horn 112, and the other side may be provided with a polarizer and a second orthogonal mode transducer 122 to process a wireless signal corresponding to the Ka band. One side of the second waveguide 133 may be connected to the coaxial waveguide 131 through the turnstile junction portion 130, and the other side thereof may be connected to the diplexer 140.

The turnstile junction portion 130 may be formed to interconnect the coaxial waveguide 131 and the second waveguide 133. Here, the turnstile junction portion 130 may include four double-rigid waveguides 134, which interconnect the outer side of the coaxial waveguide 131 and the second waveguide 133 in such a way that the X- and Ku-band wireless signals are spaced, respectively, by more than half wavelength on the orthogonal mode basis. The double-rigid waveguides may space a vertical polarization and a horizontal polarization from each other by the half wavelength, thereby realizing turnstile matching.

Figure 5:
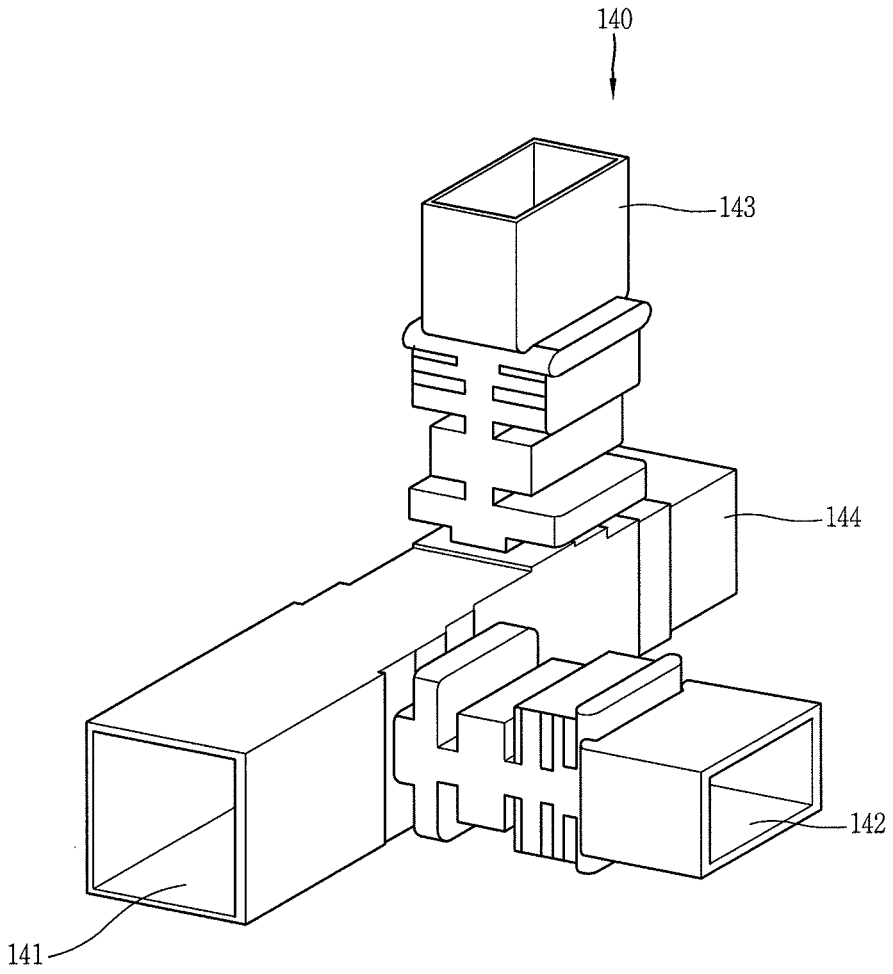
FIG. 5 is a perspective view of an X- and Ku-band diplexer of antenna system for the triple-band satellite communication in accordance with the one exemplary embodiment disclosed herein.

FIG. 5 is a perspective view of the X- and Ku-band diplexer 140 of the antenna system 100 for the triple-band satellite communication in accordance with the one exemplary embodiment disclosed herein.

The X- and Ku-band diplexer 140 may serve to separate different frequency band signals applied through a common port 141. A spherical waveguide (or a circular waveguide) used as the common port 141 may construct a port to have a size allowing X- and Ku-band signals to pass therethrough. Also, the X- and Ku-band diplexer 140 may also be provided with ports (i.e., first and second ports 142 and 143) in lateral directions to separate two X-band signals which are orthogonal to each other. The waveguides constructing the first and second ports 142 and 143 may cut off other signals which are orthogonal to an applied signal, and simultaneously serve as a filter by being formed in a shape of corrugation to prevent the Ku-band signal from being applied. The X-band signal separated in the lateral direction may be transferred to the phase shifter and the polarizer, which are located at the rear surface, so as to implement a circularly polarization, and the Ku-band signal separated into a linear port (i.e., a third port 144) may be transferred to the first orthogonal mode transducer 160, thereby implementing a linear polarization.

The first orthogonal mode transducer 160 may be connected to the third port 144 so as to separate or combine horizontal and vertical polarizations of the Ku-band wireless signal.

The first to third ports 142, 143 and 144 may be arranged to be orthogonal to one another.

Figure 6A:
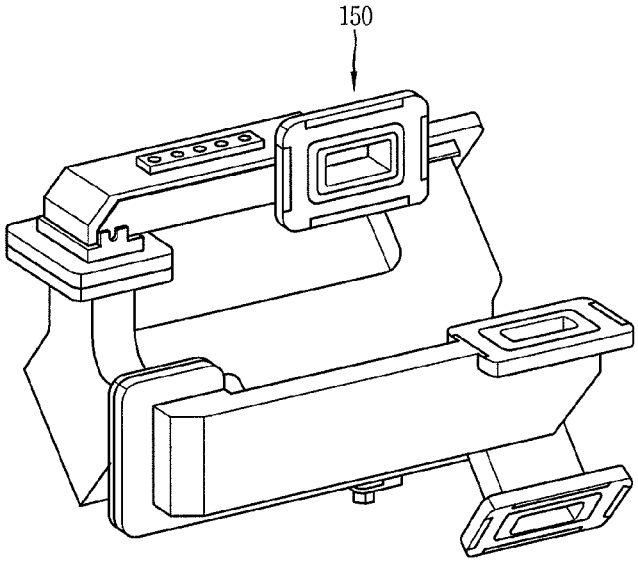
FIG. 6A is a perspective view of a polarizer assembly of the antenna system for the triple-band satellite communication in accordance with the one exemplary embodiment disclosed herein.
Figure 6B:
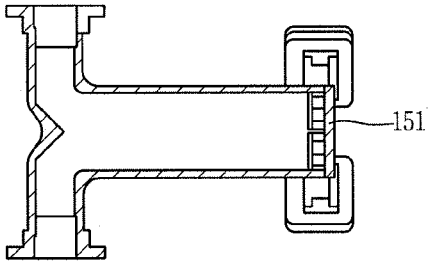
FIGS. 6B and 6C are conceptual views exemplarily illustrating a mounted state of an X-band polarizer and a phase shifter formed in the assembly.
Figure 6C:
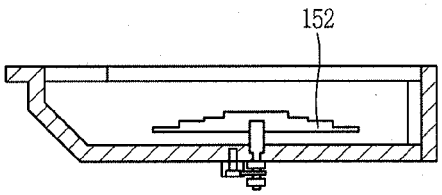

FIG. 6A is a perspective view of a polarizer assembly 150 of the antenna system for the triple-band satellite communication in accordance with the one exemplary embodiment disclosed herein, and FIGS. 6B and 6C are conceptual views exemplarily illustrating a mounted state of the X-band polarizer 151 and the phase shifter 152 formed in the assembly.

The X-band polarizer 151 may be formed in a shape of a short slot hybrid waveguide. Two outputs of the hybrid may correspond to −3 dB-couplers each having half power. Input power may be uniformly distributed, and an output signal at this moment may have a 90-degree)(90° phase difference. The four waveguides constructed as the ports have shared the same conductor wall and the formation of a middle slot and a matching step has resulted in an improvement of characteristics of signal separation, standing-wave ratio, and isolation. A circular polarization may be formed using the second and third ports 143 and 144 having a 90° phase difference upon an input through the first port 142.

The X-band phase shifter 152 may serve to compensate for a phase difference, which results from a difference of positions where the vertical and horizontal elements are separated in the X and Ku diplexer 140.

Figure 7A:
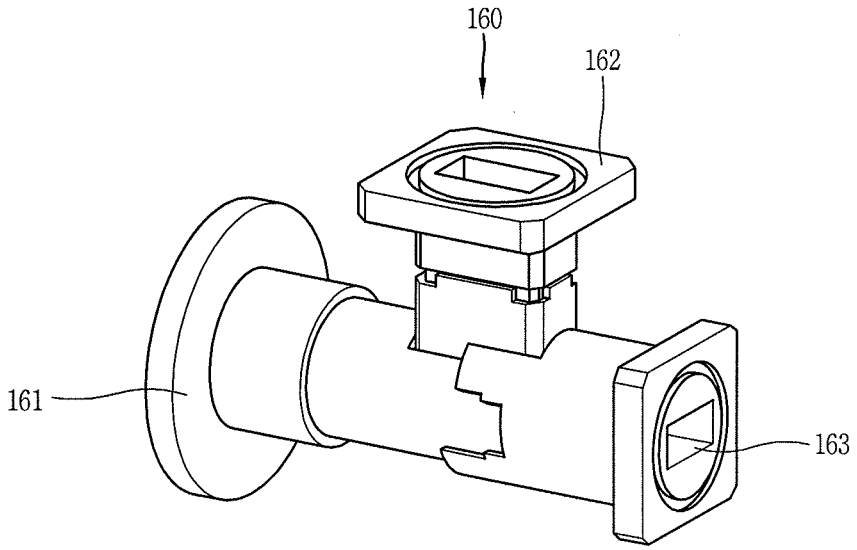
FIGS. 7A and 7B are a perspective view and a sectional view, respectively, of a Ku-band orthogonal mode transducer of the antenna system for the triple-band satellite communication in accordance with the one exemplary embodiment disclosed herein.
Figure 7B:
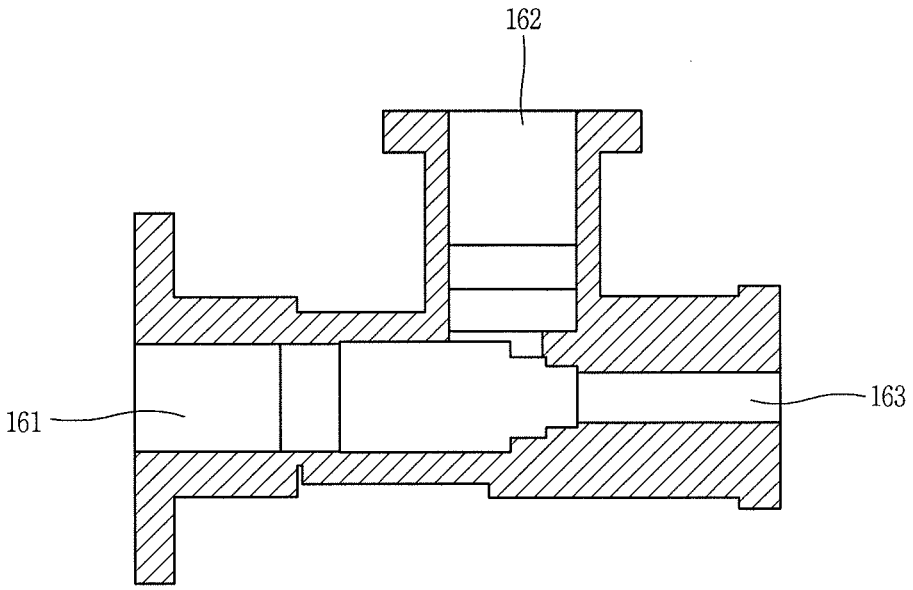

FIGS. 7A and 7B are a perspective view and a sectional view, respectively, of the first orthogonal mode transducer 160 of the antenna system 100 for the triple-band satellite communication in accordance with the one exemplary embodiment disclosed herein.

An orthogonal mode transducer may be applied to each of the first orthogonal mode transducer 160 and a second orthogonal mode transducer 122, and they are important in view of implementing a multi-band feed. For satellite communications, a transmitting channel and a receiving channel should differ in frequency and polarization to increase separation therebetween, so as to minimize an interference therebetween. Uplink satellite communications use a right-hand circular polarization or a horizontal linear polarization and downlink satellite communications use a left-hand circular polarization or a vertical linear polarization. The orthogonal mode transducer is a component carrying out a function of separating two different signals orthogonal to each other. Therefore, the present disclosure applies the orthogonal mode transducer to the Ku band using the linear polarization and to the Ka band using the circular polarization. A spherical waveguide (or a circular waveguide) is a common port, in which both vertical polarization signal and horizontal polarization signal are present. When an Ex signal as the horizontal polarization signal and an Ey signal as the vertical polarization signal are incident on the common port, the Ex signal may be cut off due to a rectangular transducer so as to be transferred only to the first port and the second port, without being transferred to the third port. On the other hand, the Ey signal may be transferred only to the third port. Here, the Ey signal may be cut off by a coupling slot of the first and second ports.

The first orthogonal mode transducer 160 may separate the Ku-band signal, which has been separated by the X- and Ku-band diplexer 140, into vertical and horizontal (or transmission and reception) elements, thereby enhancing separation between the transmission and reception signals. In view of designing each port, the common port 161 may be provided with a size of a section which is large enough to allow the transmission and reception signals to pass therethrough, and side ports (the first and second ports) and a linear port (the third port) may be provided with a size, which is large enough to allow only a signal of a corresponding frequency to pass therethrough. Each port, as illustrated in FIG. 7, may be divided into a transmission port 163 and a reception port 162.

The first orthogonal mode transducer 160 may be connected to the third port to separate or combine the horizontal and vertical polarizations of the Ku-band wireless signal. The first orthogonal mode transducer 160 may be provided therein with a stepwise impedance matching structure and a coupling slot, thereby enhancing characteristics of a return loss and isolation.

Figure 8A:
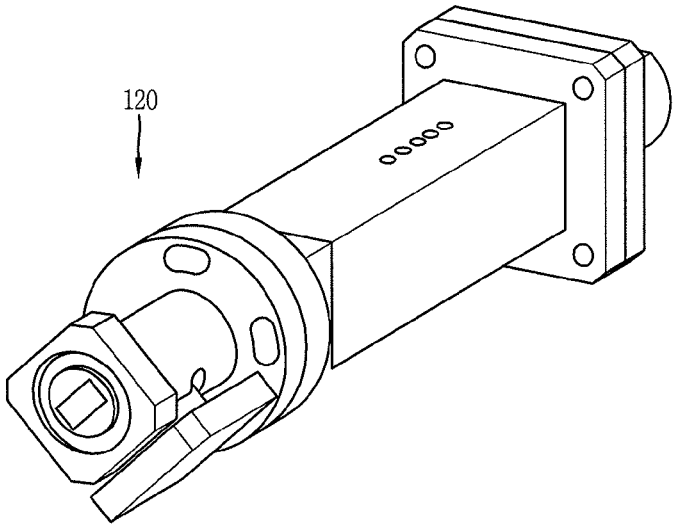
FIGS. 8A and 8B are a sectional view and a perspective view, respectively, of a Ka-band polarizer and an orthogonal mode transducer of the antenna system for the triple-band satellite communication in accordance with the one exemplary embodiment disclosed herein.
Figure 8B:
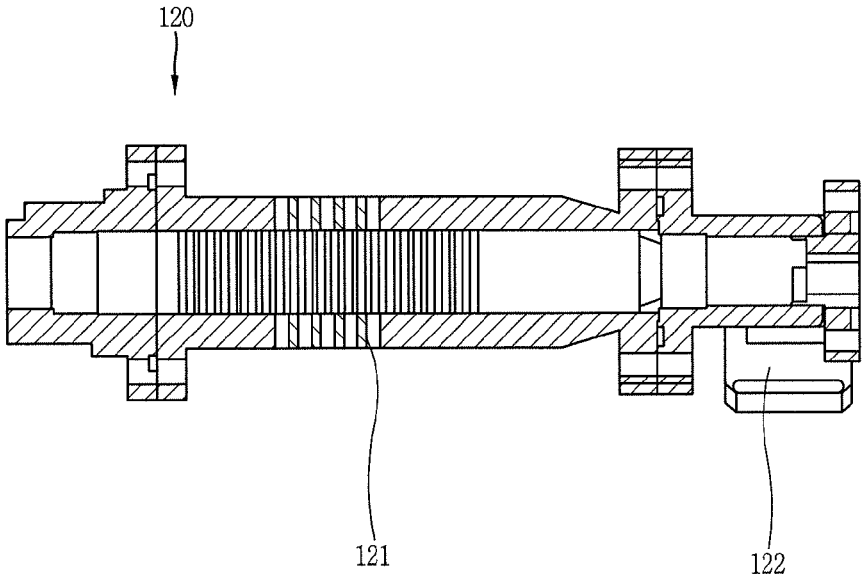

FIGS. 8A and 8B are a sectional view and a perspective view, respectively, of the Ka-band polarizer 121 and the second orthogonal mode transducer 122 of the antenna system 100 for the triple-band satellite communication in accordance with the one exemplary embodiment disclosed herein.

The polarizer 121 may be formed at one side of the first waveguide 132, to generate a circular polarization with respect to the Ka-band wireless signal. The polarizer 121 is a device for generating a linear polarization or a circular polarization to reuse the same frequency.

The second orthogonal mode transducer 122 may be connected to the polarizer 121, to separate or combine the horizontal and vertical polarizations of the Ka-band wireless signal.

Here, the 180° polarizer 121 may be used for rotating a plane of the linear polarization, and a 90° polarizer may be used for transduction between the linear polarization and the circular polarization. The polarizer 121 may be produced in a way of inserting a dielectric or magnetic substance into a waveguide to change a shape of a polarization (polarized wave), or changing a shape of a waveguide into a shape of exponential corrugation. The polarizer 121 in the form of inserting the dielectric or magnetic substance may not exhibit a broadband polarization characteristic due to large loss energy according to a medium.

Therefore, the Ka-band polarizer 121 disclosed herein may be the polarizer transformed into the corrugation shape, namely, a corrugation polarizer which is configured by forming a plurality of corrugated portions in a sawtooth shape along an inner circumference of a waveguide, which has a square section. Here, the corrugation polarizer may be designed to appropriately have a broadband characteristic, a low standing-wave ratio, and a polarization separation according to the number of corrugations. A spherical waveguide E-plane corrugation polarizer may be used for generating a circular polarization in an aperture antenna, and provide a phase shift angle of 90°±1° between TE10 mode and TE01 mode as orthogonal modes. The phase shift angle may be generated by a periodical corrugation.

The configuration and method of the aforementioned embodiments may not be applied to the antennal system for the triple-band satellite communication in a limiting manner, but those embodiments may be configured by selective combination of all or part of each embodiment so as to implement different variations.

What is claimed is:

1. An antenna system for triple-band satellite communication, comprising: a feed horn device that is configured to simultaneously radiate or absorb wireless signals of triple bands including X, Ku and Ka bands; and a waveguide section that is coupled to the feed horn device and configured to transmit input and output of the wireless signals, wherein the feed horn device comprises: a corrugation horn that is configured to radiate or absorb a first wireless signals of the X and Ku bands, the corrugation horn having a bell-like shape with a plurality of corrugations formed on an inner circumferential surface thereof in a stepped manner; and a Ka-band dielectric feed horn that is configured to radiate or absorb a second wireless signal corresponding to the Ka band which is the highest band and disposed in a central region of the corrugation horn, a reflector configured to enter the X and Ku-band signals incident thereto through the corrugation horn to a turnstile junction portion, and wherein the first wireless signals corresponded to the X and Ku bands is not radiated or absorbed through the Ka-band dielectric feed horn and the second wireless signal corresponded to the Ka band is radiated or absorbed only through the Ka-band dielectric feed horn, and wherein the first wireless signals radiated through the corrugation horn is again radiated through the reflector, and the second wireless signal radiated through the Ka-band dielectric feed horn is not radiated through the reflector.

2. The antenna system of claim 1, wherein the waveguide section comprises:

a coaxial waveguide having an inner side configured to interconnect the Ka dielectric feed horn and a first waveguide, and an outer side configured to interconnect the corrugation horn and a second waveguide; and a turnstile junction portion that is configured to interconnect the coaxial waveguide and the second waveguide.

3. The antenna system of claim 2, wherein the turnstile junction portion comprises four double-rigid waveguides that are configured to interconnect the outer side of the coaxial waveguide and the second waveguide such that the wireless signals of the X and Ku bands are spaced, respectively, by more than half wavelength on the orthogonal mode basis.

4. The antenna system of claim 3, further comprising a diplexer connected to the turnstile junction portion and configured to separate or combine the wireless signals of the X and Ku bands, wherein the diplexer comprises:

a common port; and first to third ports connected to the common port and orthogonal to one another, wherein a horizontal polarization and a vertical polarization of the X-band wireless signal are separated or combined for transmission through the first and second ports, and the Ku-band wireless signal is transmitted through the third port.

5. The antenna system of claim 4, further comprising a first orthogonal mode transducer connected to the third port and configured to separate or combine a horizontal polarization and a vertical polarization of the Ku-band wireless signal.

6. The antenna system of claim 5, further comprising a polarizer formed at one side of the first waveguide, and configured to generate a circular polarization with respect to the Ka-band wireless signal.

7. The antenna system of claim 6, further comprising a second orthogonal mode transducer connected to the polarizer and configured to separate or combine a horizontal polarization and a vertical polarization of the Ka-band wireless signal.

8. The antenna system of claim 6, wherein the polarizer is a corrugation polarizer configured in a manner of forming a plurality of corrugated portions in a sawtooth shape along an inner circumference of a waveguide having a square section.

* * * * *